United States Patent [19]

Phillips

[11] 4,207,274

[45] Jun. 10, 1980

[54] CARBURETOR

[75] Inventor: Oliver V. Phillips, Wheat Ridge, Colo.

[73] Assignee: Karl M. Johnson, Jackson, Wyo.

[21] Appl. No.: 935,946

[22] Filed: Aug. 23, 1978

Related U.S. Application Data

[63] Continuation-in-part of Ser. No. 754,031, Dec. 23, 1976, abandoned.

[51] Int. Cl.[2] ..... F02M 9/08

[52] U.S. Cl. ..... 261/50 A; 261/88; 261/52; 261/DIG. 8; 261/DIG. 38

[58] Field of Search ..... 261/50 A, 88, 89, 52, 261/DIG. 8, DIG. 38

[56] References Cited

U.S. PATENT DOCUMENTS

| | | | |
|---|---|---|---|
| 1,407,356 | 2/1922 | Swan | 261/DIG. 8 |
| 1,606,491 | 11/1926 | Abernethy et al. | 261/DIG. 8 |
| 1,932,764 | 10/1933 | Benjamin et al. | 261/50 R |
| 2,131,848 | 10/1938 | Robidoux | 261/50 R |
| 2,156,128 | 4/1939 | Shaft | 261/DIG. 38 |
| 2,314,170 | 3/1943 | Snyder | 261/50 A |
| 2,580,384 | 1/1952 | Hazen et al. | 261/88 |
| 3,322,408 | 5/1967 | Stoltman | 261/52 |
| 3,339,900 | 9/1967 | De Rugeris | 261/50 A |
| 3,439,903 | 4/1969 | Tolnai | 261/44 R |
| 3,469,825 | 9/1969 | Du Bois | 261/DIG. 38 |
| 3,875,266 | 4/1975 | Fonagy | 261/50 A |
| 3,920,778 | 11/1975 | De Rugeris | 261/50 A |
| 3,953,548 | 4/1976 | Knapp et al. | 261/50 A |
| 3,957,930 | 5/1976 | Birmingham | 261/44 R |
| 3,994,998 | 11/1976 | Mineck | 261/50 A |
| 4,005,161 | 1/1977 | Shimo et al. | 261/52 |
| 4,021,511 | 5/1977 | Kaufman | 261/DIG. 78 |

FOREIGN PATENT DOCUMENTS

| | | | |
|---|---|---|---|
| 208141 | 11/1923 | United Kingdom | 261/88 |

*Primary Examiner*—Tim R. Miles

*Attorney, Agent, or Firm*—Vinson & Elkins

[57] ABSTRACT

A carburetor for internal combustion engines having a stationary metering element and a rotor assembly which is movable and rotatable with respect to the metering element to control the fuel-air mixture and to thoroughly admix the fuel and air before its passage to the engine.

27 Claims, 7 Drawing Figures

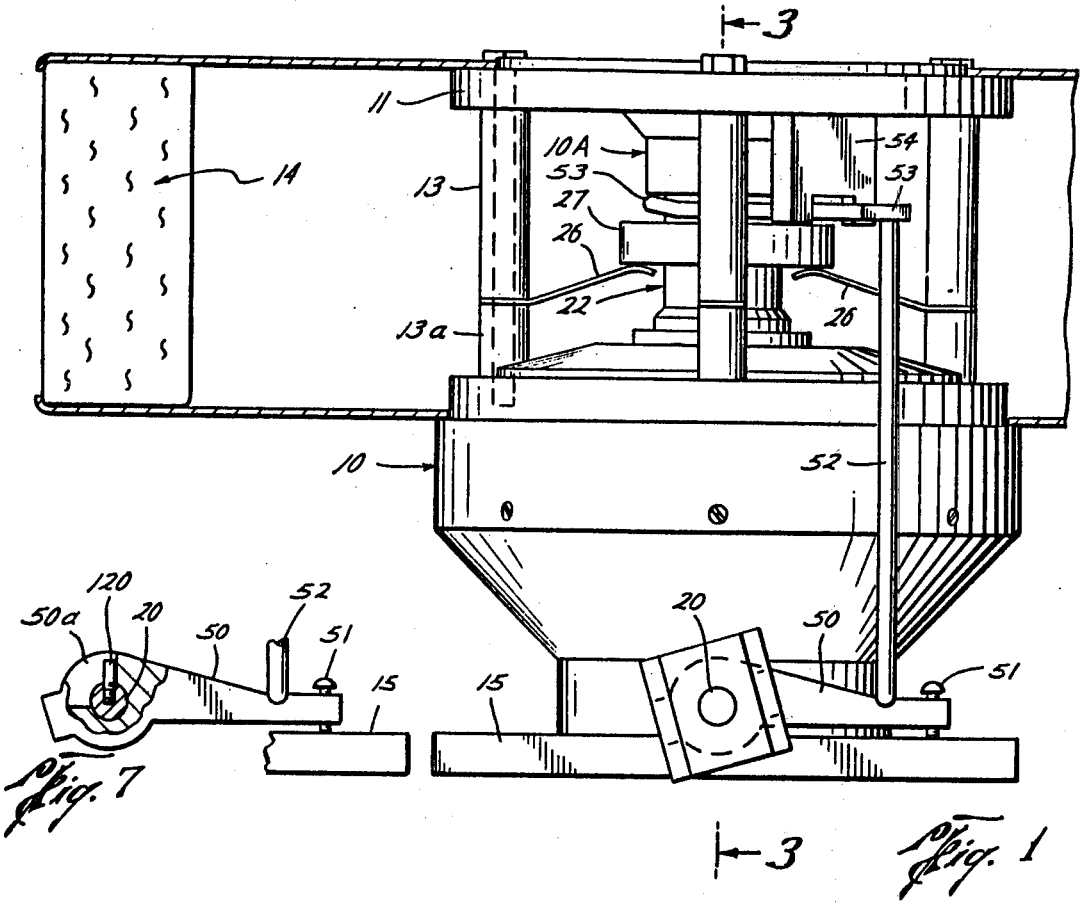
Fig. 7
Fig. 1
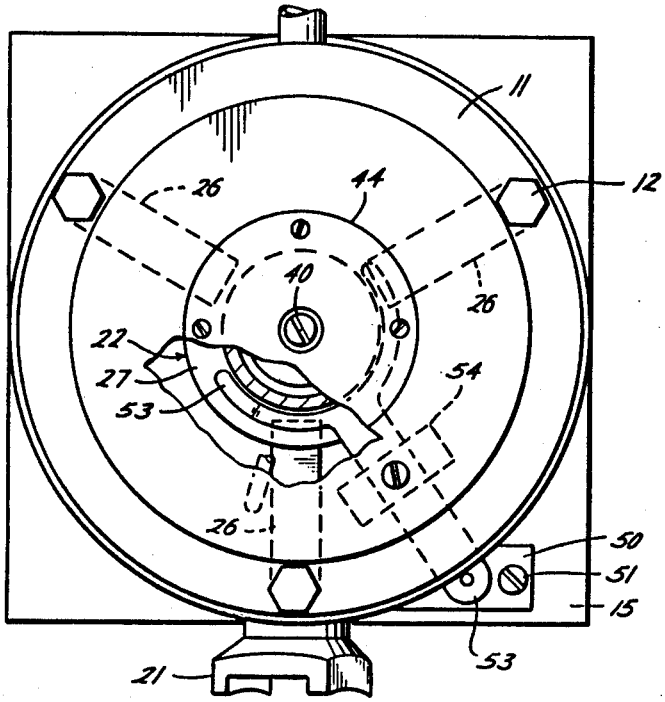
Fig. 2

CARBURETOR

REFERENCE TO RELATED APPLICATION

This application is a continuation-in-part of my prior application Ser. No. 754,031, filed Dec. 23, 1976, now abandoned.

BACKGROUND OF THE INVENTION

Carburetors which are now in general use for internal combustion engines employ conventional venturi type fuel-air ratio control systems which are quite complex in construction and adjustment. This type of system is such that it can be designed for maximum efficiency only within a relatively limited range with the result that efficiency is sacrificed outside such range. Additionally, a supplemental supply of fuel is injected under certain conditions, such as a rapid acceleration from idling position, which further complicates the apparatus involved in the system. The net result of these conventional systems is inefficient combustion which not only affects engine operation but also causes some of the unburned fuel to be discharged through the engine exhaust.

The above deficiencies in the carburetors now in use have long been recognized and various attempts have been made to design carburetors wherein the fuel supply is automatically adjusted to actual air intake regardless of the position of the air flow control means. These prior art carburetors have taken the form of a fuel valve which coacts in one manner or another with an air flow control assembly so that theoretically, any motion of the air flow control assembly also adjusts the flow of fuel accordingly. Additionally, some of these devices have rotated the air flow control assembly and have discharged the fuel into the air stream to enhance the mixture of the fuel with the incoming air. Examples of these prior art carburetors are exemplified by U.S. Pat. Nos. 1,439,573, 1,484,577, 3,265,374 and 3,339,900. Although showing the basic concept of an air flow assembly controlled by engine suction and coacting with a fuel valve, these prior devices have failed to accomplish accurate control of fuel-air mixture for various reasons, such as improper mounting of the air flow control assembly or of the fuel control valve, undesirable location of fuel and air inlets or an ineffective shape of the fuel-air mixing chamber. As a result, none of the prior art carburetors accomplish proper control of the air-fuel mixture throughout all ranges and loads of engine operation.

OBJECTS OF THE INVENTION

One of the objects of this invention is to provide a carburetor in which the fuel supply is automatically adjusted to the actual air intake regardless of the position of the air flow control means.

An important object of the invention is to provide a carburetor having a fuel metering element which is mounted in a fixed position within the carburetor housing and which is adapted to coact with a metering orifice carried by a movable rotor assembly to adjust the admission of fuel in direct ratio to the admission of air, whereby the proper fuel-air mixture is directed to the engine.

A further object of the invention is to provide a carburetor wherein the rotor assembly which is actuated by the suction of the engine is so arranged as to be positively guided by non-deformable guide surfaces and axially aligned throughout its entire travel path with respect to the fuel metering element so that accurate control of both air and fuel is obtained at all positions of said rotor assembly with respect to the metering valve.

Still another object is to provide a carburetor, of the character described, wherein the metering valve element is stationary to assure perfect axial alignment of such element at all times; said metering valve element being so mounted within the carburetor housing as to be readily adjustable.

A further object is to provide a carburetor, of the character described, wherein the rotor of the rotor assembly has an upper inclined surface coacting with the wall of the housing to control the entry of air past the rotor and into the mixing chamber; said surface being formed with upstanding fins disposed at an angle relative to a radial direction to form air channels, with a portion of said surface being exposed to the incoming air, so that the area of said exposed portion controls the air entry through said passages and also controls the abruptness of the change in direction of the air flow, whereby the force generated by the inertia of said change acts upon the fins to initiate and accelerate rotation of the rotor even at low speeds.

Another object is to provide a carburetor, of the character described, wherein flat suspension springs may be used instead of elongate coiled springs to act upon the metering valve element and wherein the only movable part is the rotor control assembly; the carburetor also including a fuel-air mixing chamber which is of relatively low height so that the device readily fits within the space provided for the usual carburetor.

A particular object of the invention is to mount said rotor assembly in such manner with respect to the metering valve element that a minimum number of seals are necessary to effectively seal during movement of the assembly with minimum frictional resistance which assures accuracy and consistency in the metering operation.

Other objects and advantages of the present invention are hereinafter set forth and are explained in detail with reference to the drawings wherein:

FIG. 1 is a side elevation of a carburetor constructed in accordance with the invention and showing an air cleaner mounted thereon;

FIG. 2 is a plan view of FIG. 1 with the air cleaner omitted and showing certain parts in dotted lines and other parts partially in elevation;

FIG. 7 is a detail view of the last motion connection between the butterfly valve shaft and the primer rod.

DESCRIPTION OF PREFERRED EMBODIMENT

Figure 3:
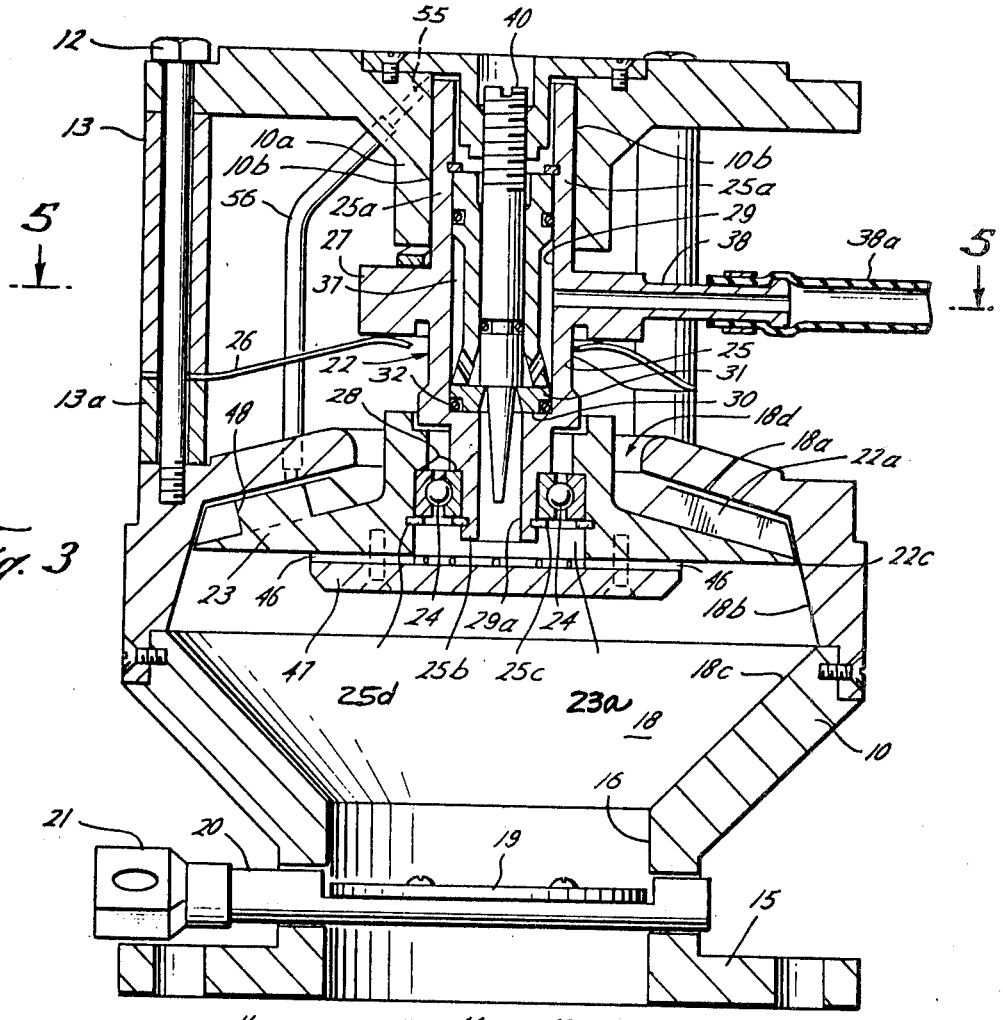
FIG. 3 is a vertical sectional view taken on the line 3—3 of FIG. 1 with the rotor assembly raised and the fuel inlet valve closed.

In the drawings, the numeral 10 designates the lower portion of the carburetor housing which is generally cylindrical in shape and formed of two sections connected by suitable screws. The upper portion 10*a* of the carburetor housing is of reduced diameter and has the bore 10*b* formed therein; also said portion is provided with a circular flange 11 at its upper end which is connected to the lower portion of the housing through elongate tie bolts 12. The tie bolts extend through spacer sleeves 13 and 13*a* which are interposed between flange 11 and said lower portion 10 of the housing. An air cleaner 14 of any suitable design is mounted to surround the housing and is of usual construction to filter the air which will be drawn into the carburetor. Any suitable means (not shown) may be utilized to secure the air cleaner in place.

The lower portion of the housing 10 has an adapter flange 15 which is adapted to be connected to the intake manifold of the engine (not shown). As is clearly shown in FIG. 3, the flange 15 and lower end of the housing has an outlet bore 16 which establishes communication between the engine manifold and a fuel-air mixing chamber 18. Said chamber is defined by an overhanging inclined wall surface 18*a*, an inclined wall surface 18*b* of increasing diameter, and an inclined wall surface 18*c* of decreasing diameter; the wall surface 18*c* terminates at the upper end of the bore 16. A circular air inlet 18*d* is located in the central portion of the upper overhanging wall of the lower housing.

Any suitable throttle valve which is herein shown as the usual butterfly valve 19 is mounted upon a throttle valve shaft 20, one end of which has a connector 21 for connecting said shaft with the usual accelerator control of the engine to be operated. When the throttle valve 19 is opened, the engine suction will act within the mixing chamber 18 through the bore 16 to draw the air-fuel mixture into such chamber.

Figure 5:
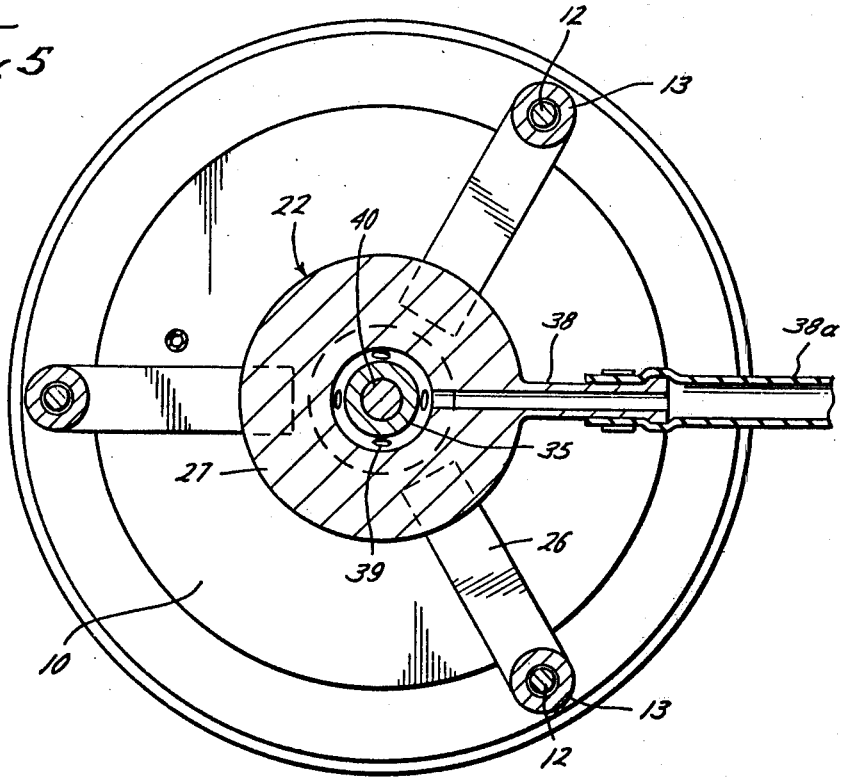
FIG. 5 is a horizontal cross-sectional view taken on the line 5—5 of FIG. 3.

Mounted within the mixing chamber 18 is a rotor assembly generally indicated by 22 and such assembly includes the rotor 23 mounted upon suitable bearings 24 which, in turn, are supported by an annular or tubular body 25. The body 25 is supported between the lower housing 10 and the upper housing 10*a* of the carburetor by means of flat cantilever-type springs 26 which bear against the underside of an external flange 27 formed integral with the central portion of body 25. The outer ends of the springs are confined between the spacer sleeves 13 and 13*a* through which the tie rods extend and said springs urge the rotor assembly upwardly to move the upper surface of the rotor 23 into its upper position relative to the wall surface 18*a*. The use of flat springs is preferable because such springs have much better linearity than the standard coil springs and also reduce the overall height of the carburetor. Although three flat springs have been shown (FIG. 5), more or less may be provided.

Figure 4:
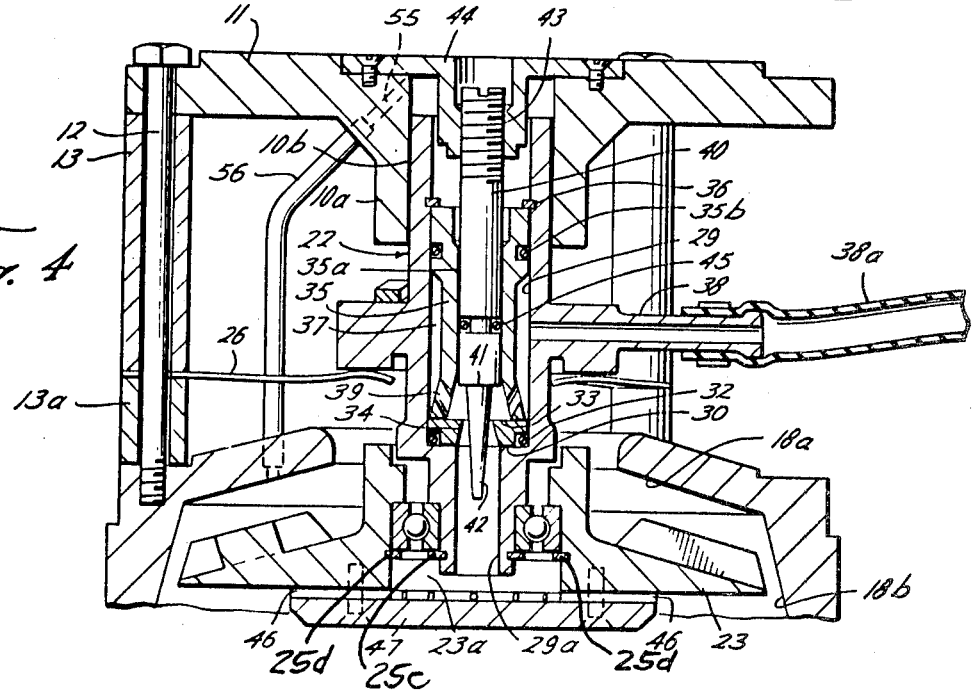
FIG. 4 is a partial vertical sectional view similar to FIG. 3, with the rotor assembly moved downwardly and the fuel assembly moved downwardly and the fuel inlet valve open.

Rotor assembly 22 consisting of rotor 23 and the tubular body 25 and associated parts are most clearly shown in FIGS. 3 and 4. In FIG. 3, the rotor assembly is in its uppermost position within the upper housing 10*a* with the upper surface of the rotor in close proximity to the wall surface 18*a*. The annular body 25 of the rotor assembly has an upper extension 25*a* which has a sliding contact within the bore 10*b* formed within the upper housing 10*a*. The lower portion of the body 25 below the annular flange 27 is reduced as shown at 25*b*, and the bearings 24 surround such reduced portion with the upper surfaces of the bearing rings engaging annular horizontal shoulders 28 on the body 25 and on the rotor 23; the bearings are retained in position by retainer rings 25*c* to rotatably mount the rotor on the body 25. Upward displacement of the rotor with respect to the bearings and the body 25 is prevented by retainer 25*d*.

A bore 29 extends completely through the body 25 and is reduced at its lower end as indicated at 29*a* to form an annular support shoulder 30. An annular valve seat 31 is supported on this shoulder and is sealed with the bore of the body 25 by a suitable sealing ring 32. The upper surface 33 of the valve seat is flat while the bore of the valve seat is tapered and enlarged in a downward direction to form a metering orifice 34.

Secured within the bore 29 of the body 25 above the valve seat 31 is a guide sleeve 35 having a bore 35*a*. The lower end of the sleeve is slightly flared and rests upon the valve seat 31 and said sleeve is retained in place by a snap ring 36 secured within the bore of the tubular body 25 and engaging the upper end of sleeve 35. An O-ring or other static seal 35*b* seals between the sleeve and the bore of body 25.

The exterior intermediate portion of the sleeve 35 is reduced to form an annular space 37 surrounding the sleeve, which space communicates with a radially directed tubular fuel inlet 38. Such tubular inlet is connected to a flexible fuel line 38*a* which permits vertical movement of the sealed inlet 38 with the rotor assembly to which the inlet is attached. Fuel ports 39 are formed in the lower end of the sleeve 35 and provide a communication between the fuel inlet 38 and annular space 37 with the metering orifice 34 of the valve seat. The fuel ports 39 are so sized with respect to the total fuel supply system that they create sufficient constriction to support a back pressure in the system to thereby minimize the possibility of so-called "vapor lock" in the system.

For controlling the admission of fuel past the valve seat 31 and through the metering orifice 34, a metering rod 40 is provided. The rod is generally cylindrical throughout its length but near its lower end is formed with an annular seating surface 41 adapted to be engaged by the upper surface 33 of the valve seat. Below the shoulder 41 is a metering pin 42 which may be tapered in any desired manner to control the volume of fuel which will pass through the metering orifice 34 when the valve seat moves downwardly away from the seating surface 41.

The metering rod 40 is securely positioned within the upper housing through threads 43 which engage the threaded bore of a metering rod retainer element 44 secured to the upper central portion of the upper housing 10*a*. Because the carburetor has been found to be extremely sensitive, it is desirable that the threads 43 be of a fine pitch to obtain desirable minute adjustment changes. An annular seal 45, such as an O-ring, surrounds the intermediate portion of the metering rod 40 and provides a seal between the exterior of the rod and the bore 35of the sleeve 35. When the rotor assembly 22 moves downwardly within the housing of the carburetor, the upper surface 33 of the valve seat 31 moves away from the seating surface 41 of the metering rod. Upon this occurring, fuel entering through the inlet 38 passes through the annular space 37, ports 39 and flows through the metering orifice 34 formed by the bore of the valve seat.

Since the guide sleeve 35 is of substantial length, said sleeve is guided during its entire vertical movement to maintain proper alignment of the body 25 and of the metering orifice 34 axially with respect to the metering pin 42 of the metering rod. By properly shaping the orifice 34 and the external surface of the metering pin 42, a very accurate control of fuel admitted may be maintained throughout the entire movement of the rotor assembly. It is noted that there is only one seal, namely the O-ring 45, which is subjected to any sliding motion; the seal 32 associated with the valve seat and the seal 35*b* associated with the sleeve 35 are static seals which have no effect upon the moving parts.

As above noted, the guide sleeve is of a considerable length and its bore engages the external surface of the metering rod 40 throughout the major portion of the length of said rod to assure proper guiding; also the rod is relatively large in diameter to prevent its bending if transverse forces should act upon the rotor assembly 22 and be transmitted to said rod. Additionally, since the upper tubular extension 25*a* of the rotor assembly body 25 has a sliding contact with the bore 10*b* of the relatively heavy upper housing 10*a* with very little clearance, said extension acts as a secondary guide surface which, together with the primary guide surface formed by the guide sleeve, assures accurate alignment of the metering orifice 34 with the metering pin 42 of said metering rod. It is preferable that the engaging surfaces of the metering rod 40, and the guide sleeve 35, as well as the engaging surfaces of the extension 25*a* and housing 10*a* be of a substantially non-deformable material, such as metal or hard plastic.

With the rotor assembly moved downwardly to permit the admission of fuel past the orifice 34, said fuel flows into a chamber 23*a* formed within the lower end of the rotor 23, which chamber is closed except for radial passages 46 formed in the upper surface of a plate 47 suitably secured to the lower end of the rotor. The outer ends of passages 46 communicate with the mixing chamber 18 so that the fuel which passes through the orifice is discharged into said chamber.

Figure 6:
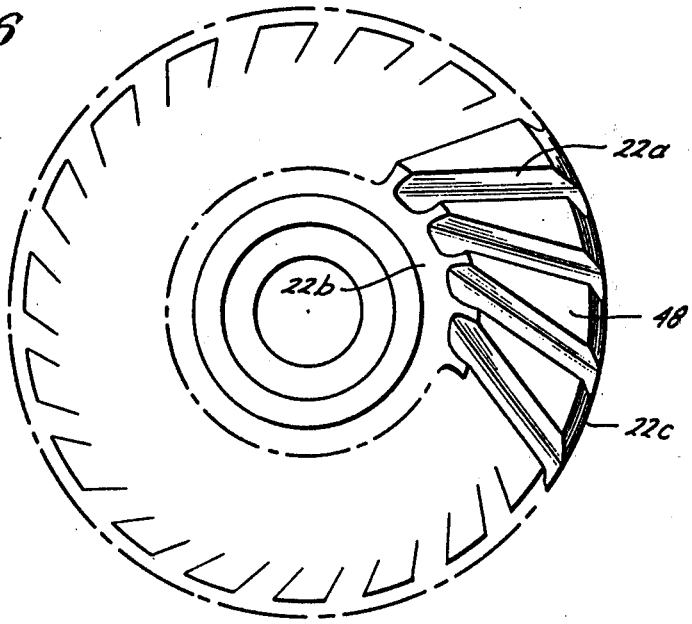
FIG. 6 is a plan view of the rotor illustrating the disposition of the fins on the upper surface.

The rotor which is mounted upon the bearings 24 is a circular member generally conical in shape with its upper surface substantially conforming to the overhanging wall surface 18*a* of the mixing chamber of the housing. The upper surface of said rotor is formed with grooves 22*a* (FIG. 6) which are cut at an angle relative to a radial direction extending from the rotor center. Each groove extends from the periphery of the rotor and terminates at a point short of the hub of said rotor so that the area adjacent the hub is an annular smooth surface 22*b*. The cutting of the grooves 22*a* forms a plurality of upstanding fins or blades 48 on the upper surface of the rotor and such fins or blades also extend from the rotor periphery to the smooth surface 22*b* at an angle to a true radial direction. The grooves provide air channels or passages in the upper surface of the rotor which channels are open at both ends.

Since the inclination of the upper surface of the rotor generally conforms, or is generally parallel to the upper overhanging wall surface 18*a*, the rotor coacts therewith during initial downward movement of the rotor to control the admission of air into the mixing chamber 18. It is noted, however, that when the rotor is in its uppermost position, the air channels or passages formed by the grooves 22*a* are not completely closed; at this time, the peripheral surface 22*c* of the disk is closely adjacent the inclined wall 18*b* and substantially, although not completely shuts off air flow into the chamber. Because the peripheral surface 22*c* is the closest point to the inner wall surface 18*b* of the chamber when the rotor is in its uppermost position, the spacing between the periphery and wall determine the minimum air flow into the chamber at this time.

When the rotor initially moves downwardly from its uppermost position, the air entering through air inlet 18*d* is forced to abruptly change direction of flow in order to follow the air channels. This applies a substantial force to the fins or blades 48 because of the inertia force developed by said rapid change of direction of flow which assures immediate and rapid rotation of the rotor. As the rotor moves downwardly, its peripheral surface 22*c* moves axially of the chamber and by reason of the inclined wall 18*b* of increasing diameter, an additional volume of air is admitted to the chamber. By properly selecting the strength of the springs 26 and predetermining the angle of inclination of the wall 18*b* with respect to the diameter of the disk, the exact volume of air entering the chamber at various engine speeds is controlled. Such air volume is also related to the predetermined angle of taper on the fuel metering pin 42 and in this manner, the proper fuel-air mixture is delivered to the engine being operated in all positions of the rotor assembly relative to the metering rod 40.

When the rotor is pulled downwardly by the suction of the engine, due to opening of the butterfly valve 19, air enters the mixing chamber through the air inlet 18*d* and through the air channels in the top surface of the rotor 23. This incoming air, upon striking the fins 48, imparts a rotation to the rotor which effects a spinning of the rotor so that the fuel which is discharging from the fuel passages 46 in the lower portion of the rotor is caused to disburse or entrain and admix with the air flowing into the chamber 18 between the rotor and the walls of the lower housing 10.

The mixing chamber 18 is relatively shallow in height and has the outwardly inclined wall 18*b* of increasing diameter extending from the overhanging wall surface 18*b* to the lower inclined wall 18*c* of decreasing diameter which terminates at the upper end of the bore 16 in the lower portion of the housing. This configuration of the chamber creates a low pressure area at the outer peripheral edge of the rotor member and draws the fuel which is being centrifugally discharged through the ports 46 into intimate entrainment with the air. As the fuel and air admix and travel along the wall 18*b*, the mixture suddenly encounters the inclined wall 18*c* to change its direction and further turbulence is created to assure that a thorough mixing of the fuel with the air and a total distribution of such fuel throughout the mixture will be effected.

Because the horizontal seating surface 41 of the metering rod engages the flat upper surface of the valve seat 33, there is a positive shutoff of fuel when the parts are in the position shown in FIG. 3. In order to provide for easy starting, an actuating arm 50 is attached to the throttle shaft 20 with a lost motion connection as best shown in FIG. 7. The shaft 20 has a pin 120 which engages within a slot 50*a* provided in the arm 50 so that the butterfly valve must be opened a substantial distance before the arm 50 is moved. The outer end of this arm is adapted to extend over the adapter flange 15 and is held in a predetermined position with respect thereto by an adjusting screw 51. A primer rod 52 has its lower end engaged by the arm 50 and its upper end engages the underside of an actuating fork 53.

The actuating fork 53 extends through a retainer block 54 (FIG. 2) and overlies the upper end of the external flange 27 which is formed on the tubular body 25 of the rotor assembly. When the throttle valve of the engine is opened sufficiently beyond the lost motion connection, the shaft 20 is rotated and the outer end of arm 50 is raised which, due to the fulcrum action, causes the fork 53 to urge the rotor assembly in a downward direction against the strength of the support springs 26. As soon as a downward motion of the rotor assembly occurs, the upper surface 33 of the valve seat 31 will move downwardly away from the seating surface 41 of the metering rod, thereby permitting fuel to pass through metering orifice 34 into chamber 29*a* within the rotor 23 and to be discharged outwardly through the radial passages 46. With this arrangement, upon a wide opening of the throttle, fuel is introduced into the engine for starting.

As previously explained, the annular extension 25*a* of the body of the rotor assembly is movable and has a sliding contact within the bore 10*b* of the upper housing 10*a*. Moving with the body 25 is the guide sleeve 35 and upward movement of the parts is stopped when the upper portion of the valve seat engages the seating surface 41 of the stationary metering rod 40. Because of the close sliding contact between extension 25*a* and bore 10*b* there may be some accumulation or condensation occurring above the upper ends of the annular extension 25 and its attached guide sleeve 35, and in order to vent the upper end of the space within which these parts move, an inclined port 55 (FIG. 3) is formed within the upper housing 10*a* and has a vent tube 56 connected thereto. The vent tube preferably extends into the area just above the rotor so as to discharge within the air channels of said rotor and thereby be discharged into chamber 18.

In operation, when the rotor assembly is in its uppermost position (FIG. 3) there is a positive shutoff of the fuel because the flat seating surface 41 of the metering rod is engaged by the upper flat surface 33 of the valve seat 31. In this position, the air inlet to the mixing chamber 18 is substantially closed because the peripheral position 22*c* of the rotor is in close proximity to the wall 18*b* of the mixing chamber. It is understood that the taper of the metering pin 42 and its relationship to the metering orifice 34, as well as the size of the rotor and the air channels and the force of springs 26, have been predetermined in accordance with the engine to be operated.

As is well known, all butterfly valves in carburetors have a preset opening when the engine is not operating. This preset opening is for the purpose of permitting a flow of air and fuel immediately upon starting of the engine to provide for sufficient air-fuel mixture at idling speed. In the present carburetor, the butterfly valve has such preset opening. When such preset opening is not sufficient to produce engine starting, the accelerator can be depressed beyond the lost motion connection consisting of the pin 120 and slot 50*a*, which actuate the primer rod 52 to mechanically increase the fuel supply and thereby enrich the mixture.

When the engine is started by opening the butterfly valve 19, a suction acts upon the rotor assembly to move it downwardly and permit fuel to flow through the metering orifice 34 in the valve seat. At the same time, the rotor is moved away from the inclined upper inner wall surface 18*a* of the overhanging wall of the lower housing. Such movement permits air to enter the air inlet 18*b* and because of its abrupt change in direction in order to pass through the air channels, such incoming air instantaneously imparts rotation to the rotor. Since fuel is discharging through the passages 46, the rotation of the rotor centrifugally discharges the fuel into the air passing into the mixing chamber over the periphery of the rotor. Assisting the mixture of the fuel and air is the development of a low pressure zone immediately below the rotor's peripheral portion, followed by the extremely turbulent zone which is created as the air is caused to again change direction by its contact with the inwardly directed wall surface 18*c*. As the rotor assembly moves further in a downward direction the air velocity increases and the fuel discharge becomes greater and more violent to thereby increase the distribution and entrainment of fuel within the air. Because the rotor size, the metering pin and orifice sizes and the spring strength has been predetermined, the desired and proper fuel-air mixture is maintained through all positions of the rotor assembly with respect to the metering pin. This proper fuel-air mixture operates the engine at maximum efficiency because all fuel is burned; an additional advantage is produced in lowering emissions of unburned fuel through the exhaust which as is well known, reduces air pollution.

The elongate guide sleeve 35 which is secured to the rotor assembly housing 25 has an extended contact or guide surface with the stationary metering rod so that there is no chance of axial misalignment between orifice 34 and metering pin 42 in any relative position of the parts with respect to each other. Also, the O-ring 45 is the only seal which is subjected to any movement and this seal is engaged by the bore 35*a* of the guide sleeve 35. If there should be any tendency for misalignment because of a lateral shift of the entire assembly housing 25, this is further prevented by the secondary guide surfaces formed by the sliding contact between the tubular extension 25*a* of rotor assembly body and bore 10*b* of the upper carburetor housing 11. The importance of maintaining proper alignment throughout all positions of the rotor assembly with respect to the metering pin is quite evident because if there be any misalignment, the proper fuel-air mixture is not obtained.

The rotor assembly is maintined in its upper position by the flat cantilever-type springs 26 which suspend the assembly and which normally maintain it in its raised position when the engine is not operating. This use of the flat springs produce a low profile carburetor capable of mounting in the same space as the usual carburetor and also provide greater linearity than standard elongate coil springs. It should be noted that the entry of the fuel into the orifice 34 formed in the valve seat 31 is at the lower end of the guide sleeve 35 so that it does not in any way interfere with the alignment guiding action of the sleeve. It is desirable that the lower end of the guide sleeve be slightly flared outwardly and that the entry ports 39 be provided in this area. The threading of the metering rod into its support permits the metering pin to be accurately adjusted for idling purposes if such is required.

In the event of a back-fire of the engine, the force of the same will instantaneously move the rotor to its uppermost position. In such position, the peripheral surface 22*c* of the rotor is so close to the inner wall surface of the chamber that there is insufficient space for the ignited fuel creating the back-fire to pass. This results in the pressure being momentarily confined to the manifold system but it may be subsequently gradually released through the relatively small annular space around the periphery of the rotor. Thus, the back-fire is effectively snuffed out.

The foregoing disclosure and description of the invention are illustrative and explanatory thereof and various changes in the size, shape and materials, as well as in the details of the illustrated construction, may be made within the scope of the appended claims without departing from the spirit of the invention.

What I claim is:

1. A carburetor for an internal combustion engine comprising, a housing having a fuel-air mixing chamber in its lower portion and having a fuel inlet in its upper portion, an air inlet in the upper end of the mixing chamber, a rotor assembly movable vertically within said housing and coacting with the air inlet to substantially close the same when said assembly is at the end of its travel in one direction relative to the housing and to open said inlet upon movement of the assembly in the opposite direction of travel, resilient means between the rotor assembly and the housing for urging the rotor assembly in that direction which substantially closes the air inlet, a metering valve within the housing comprising a metering element mounted in a stationary position in the housing and a metering orifice carried by the rotor assembly, means for conducting fuel from the fuel inlet to said metering valve, the metering orifice of the rotor assembly coacting with the stationary metering element to control passage of fuel past the valve in accordance with the relative axial position of the rotor assembly with respect to the housing, such axial position of the rotor assembly also controlling the volume of air admitted to the mixing chamber, means for conducting the fuel which passes the metering valve through the rotor assembly and into the mixing chamber to mix with the admitted air and form the fuel-air mixture which is thereafter conducted to the engine being operated, means for positively guiding the rotor assembly in its axial movement within said housing to maintain accurate axial alignment of the metering orifice about the metering element througout the entire travel of the rotor assembly with respect to said metering element, and said means for positively guiding said rotor assembly including an elongate non-deformable guide surface forming part of the rotor assembly located between the rotor assembly and the metering element and having sliding contact with the exterior of the metering element whereby said elongate guide surface functions to prevent any lateral movement of the rotor assembly relative to said metering element during movement of the rotor assembly with respect to the element.

2. A carburetor for an internal combustion engine as set forth in claim 1, wherein the metering element is mounted axially within the upper portion of the housing and is formed with a depending tapered metering pin, and the metering orifice formed in the rotor assembly is so located on said assembly as to be axially aligned with the metering pin in all positions of the rotor assembly relative to the housing.

3. A carburetor as set forth in claim 1, together with means mounting the metering element axially within the housing, means within the housing for guiding the rotor assembly in its axial movement within said housing to maintain accurate axial alignment of the metering orifice about the metering element throughout the entire travel of the rotor assembly with respect to said metering element, and coacting means on the valve element and on the rotor assembly adjacent the metering orifice for positively closing the metering valve when the rotor assembly is in a position substantially closing the air inlet.

4. A carburetor as set forth in claim 1, together with a rotor member rotatably mounted on the lower end of the rotor assembly and located within the fuel-air mixing chamber, means on the upper surface of the rotor exposed to the air flowing into said chamber and responsive to such flow for imparting a spinning motion to said rotor, and a plurality of radially extending passages in said rotor and forming part of the means which conducts fuel from the metering valve to the chamber, whereby the fuel is discharged into said chamber in a multitude of fuel streams which entrains, distributes and mixes said fuel with the air in said mixing chamber.

5. A carburetor as set forth in claim 1, together with a rotor member rotatably mounted on the lower end of the rotor assembly and located within the fuel-air mixing chamber, means on the upper surface of the rotor exposed to and actuated by the air flowing into said chamber for imparting a spinning motion to said rotor, a plurality of radially extending passages in said rotor and forming part of the means which conducts fuel from the metering valve to the chamber, whereby the fuel is discharged into said chamber in a multitude of streams which entrains, distributes and mixes said fuel with the air in said mixing chamber, said metering element being mounted axially within the upper portion of the housing and having a depending tapered metering pin, and said metering orifice which is carried by the rotor assembly being located on said assembly to surround the metering pin in all axial positions of the rotor assembly relative to the housing.

6. A carburetor as set forth in claim 1, wherein said resilient means comprises a plurality of flat cantilever-type spring members extending between the housing and the rotor assembly.

7. A carburetor as set forth in claim 1, together with a single annular seal between the elongate guide surface of the rotor assembly and the metering element to minimize the frictional resistance to movement of said rotor assembly relative to the metering element.

8. A carburetor as set forth in claim 1, together with, mechanical means engaging the rotor assembly for mechanically moving said rotor assembly downwardly to supplement the engine suction in opening the metering valve and admit additional fuel for starting purposes, and means actuated by the accelerator of the engine and connected with the mechanical means through a lost motion connection for operating said mechanical means after said accelerator has moved a predetermined distance to thereby assure a satisfactory fuel-air mixture for starting to be admitted to the engine.

9. A carburetor as set forth in claim 8 wherein said mechanical means includes, a fork member engageable with an external flange on the rotor assembly, a vertically movable actuating rod having its upper end engaging said fork member to move the same and having its lower end engaged with the throttle arm control of the engine accelerator, and a lost motion connection between said throttle arm control and the intake valve of the engine, whereby after said valve has been opened a predetermined amount, the rod will actuate said fork member to move the rotor assembly and thereby admit an additional volume of the fuel-air mixture to the intake manifold of the engine.

10. A carburetor for an internal combustion engine including, a housing having a fuel-air mixing chamber in its lower portion, an air inlet in the upper end of the chamber, a fuel inlet in the upper portion of the housing, a rotor assembly movable axially within the housing, spring means extending between the rotor assembly and housing and urging the assembly to its uppermost position relative to the housing, a rotor member rotatable on the lower portion of the rotor assembly and located within the fuel-air mixing chamber, said rotor member coacting with the interior wall of the housing to substantially close the same when the rotor assembly is in its uppermost axial position relative to the housing and to open said air inlet as the assembly and rotor move downwardly therein, a fuel metering valve within the upper portion of the housing, means for conducting fuel from said fuel inlet to said metering valve, said metering valve comprising a metering element which is mounted in a fixed position in the housing and a metering orifice carried by the rotor assembly adapted to move relative to and coact with said metering element to control the flow of fuel past said valve, such movement of the rotor assembly simultaneously moving the assembly relative to the housing to control the volume of air entering said fuel-air mixing chamber, means for conducting the fuel flowing past the valve through the rotor member and into said chamber, means for exposing the rotor to the intake manifold suction of the engine to be operated, whereby the relative position of the rotor assembly orifice to the fixed metering element and the relative position of the rotor to the interior wall of the housing are controlled by said manifold suction to direct a properly proportioned fuel-air mixture to said intake manifold, means within the housing for positively guiding the rotor assembly in its axial movement within said housing to maintain accurate axial alignment of the metering orifice about the metering element throughout the entire travel of the rotor assembly with respect to said metering element, and said means for positively guiding the rotor assembly including a guide sleeve forming part of said rotor assembly and surrounding the major portion of the metering element in an axial direction, the bore of said guide sleeve having a sliding contact with said metering element in all positions of the rotor assembly with respect to the metering element.

11. A carburetor as set forth in claim 10, wherein the means for conducting the fuel flowing through the rotor member includes a plurality of radially extending passages in said rotor, whereby the fuel is discharged into said chamber in a multitude of streams as the rotor member rotates to assure entrainment and distribution of the fuel throughout the air within the mixing chamber.

12. A carburetor as set forth in claim 10, wherein the metering element is mounted axially within the upper portion of the housing and is formed with a depending tapered metering pin, and the metering orifice carried the rotor assembly is so located on said assembly as to surround the metering pin in all axial positions of the rotor assembly relative to the housing.

13. A carburetor as set forth in claim 10, together with coacting means on the metering element and on the rotor assembly adjacent the metering orifice for positively closing the metering valve to shut off fuel flow to the chamber when the rotor assembly is in its uppermost position relative to the housing.

14. A carburetor as set forth in claim 10, wherein the spring means comprises a plurality of flat horizontally extending cantilever-type spring members.

15. A carburetor including, a housing having a lower portion forming a fuel-air mixing chamber and an upper portion speed from and connected with the lower portion and having an axial bore, a rotor assembly including an annular body slidable within the axial bore of the upper portion and having a rotor disk rotatably mounted on its lower end and disposed within the fuel-air mixing chamber, resilient means supporting the rotor assembly on said housing and urging said assembly upwardly, the rotor disk being adapted to coact with the wall of the chamber to substantially close the air inlet when the rotor assembly is in an upper position and to open said inlet when said assembly is in a lowered position, a fuel inlet extending into the upper portion of the housing, a fuel control valve rod mounted in a fixed position in the upper end of the housing, a metering orifice mounted on the rotor assembly to coact with the valve rod and forming a fuel control valve to control flow passing the valve rod in accordance with the relative position of the metering orifice with respect to the valve rod, means conducting fuel to said fuel control valve and through the rotor disk to the mixing chamber, means on said rotor disk in the path of the air flow when the air inlet is open and acted upon by said air flow to impart a rotation to the disk to enhance the mixture of fuel discharging through the rotor with the air entering said fuel-air mixing chamber, and a non-deformable guide surface on the annular body of the rotor assembly engageable with a substantial portion of the fuel control valve rod for guiding the annular body of the rotor assembly within the bore of the housing to maintain it and its metering orifice in axial alignment with the fuel control valve rod and to prevent lateral movement of the body relative to the rod.

16. A caburetor for an internal combustion engine comprising, a housing having a fuel-air mixing chamber in its lower portion and having a fuel inlet in its upper portion, an air inlet in the upper end of the mixing chamber, a rotor assembly movable vertically within said housing and coacting with the air inlet to substantially close the same when said assembly is at the end of its travel in one direction relative to the housing and to open said inlet upon movement of the assembly in the opposite direction of travel, resilient means between the rotor assembly and the housing for urging the rotor assembly in that direction which substantially closes the air inlet, a metering valve within the housing comprising a metering element mounted in a stationary position in the housing and a metering orifice carried by the rotor assembly, means for conducting fuel from the fuel inlet to said metering valve, the metering orifice of the rotor assembly coacting with the stationary metering element to control passage of fuel past the valve in accordance with the relative vertical position of the rotor assembly with respect to the housing, such vertical position of the rotor assembly also controlling the volume of air admitted to the mixing chamber, said metering element being formed of a rod which is of a constant and uniform cross-sectional shape throughout the major portion of its length, said rod having a tapered metering pin extending downwardly therefrom, said metering orifice being formed at the lower end of an elongate non-deformable guide sleeve which is a part of the movable rotor assembly, the bore of the guide sleeve having a sliding and sealing engagement with the outer surface of the constant cross-sectional portion of said rod and having the orifice at the lower end of said sleeve encircling and coacting with the tapered metering pin to control passage of fuel past the valve, said guide sleeve functioning to prevent lateral movement of the rotor assembly relative to the rod of the metering element to thereby maintain axial alignment of the orifice in relationship to the metering pin throughout the entire travel of the rotor assembly with respect to the metering element.

17. A carburetor as set forth in claim 16, together with a flat closure surface on the metering element at the intersection of the lower end of the cylindrical portion of the rod and the upper end of the tapered metering pin and extending in a plane which is normal to the axis of the metering element, and a complementary flat surface at the upper end of the metering orifice adapted to engage the flat surface on said metering element to effect a positive closure of the orifice and shut-off of the fuel when the rotor assembly is in its uppermost position relative to the metering element.

18. A carburetor for an internal combustion engine including, a housing formed of a lower portion having a fuel-air mixing chamber therein and an upper portion spaced from but connected to said lower portion, said upper portion having a central bore, the lower end of which is open and the upper end of which is closed, an air inlet in the upper end of the fuel-air mixing chamber, a rotor assembly movable vertically with respect to both upper and lower portions of the housing, a rotor member rotatable on the lower end of the rotor assembly and located within the fuel-air mixing chamber, spring means extending between the rotor assembly and the housing and urging said assembly to its uppermost position relative to the housing, means on the upper end of the rotor assembly slidable within the bore of the upper portion of the housing to maintain alignment of the rotor assembly with respect to the housing, said rotor member coacting with the interior wall of the mixing chamber to substantially close the air inlet when the rotor assembly is in its uppermost position relative to the housing and to open said air inlet as the assembly and rotor member move downwardly therein, a fuel inlet connected with the rotor assembly for conducting fuel to the interior of the assembly, a fuel metering valve within the interior of said assembly, means for conducting said fuel from the metering valve into the fuel-air mixing chamber, said fuel metering valve comprising a metering element having its upper end connected in a predetermined fixed position within the upper portion of the housing and a metering orifice mounted in the rotor assembly and movable relative to the metering element to coact therewith to control flow past the metering valve, such movement of said rotor assembly simultaneously moving the rotor relative to the interior wall of the chamber to control the volume of air entering said fuel-air mixing chamber, and non-deformable guide means within the rotor assembly and slidably engaged with a substantial portion of the exterior surface of the metering element for positively guiding the rotor assembly in its vertical movement to prevent lateral movement of the rotor assembly relative to the metering element to thereby maintain accurate axial alignment of the metering orifice about the metering element throughout the entire travel of the rotor assembly with respect to the metering element.

19. A carburetor as set forth in claim 18, wherein the spring means comprises a plurality of cantilever-type flat springs which extend between the housing and the rotor assembly.

20. A carburetor as set forth in claim 18, wherein the upper end of the metering element is threaded into the upper portion of the housing, whereby its position relative to the rotor assembly may be adjusted.

21. A carburetor as set forth in claim 18, wherein the metering element is a rod which is cylindrical in cross-section throughout the major portion of its length and having a tapered metering pin extending downwardly from said cylindrical portion, and wherein said metering orifice is so located on the rotor assembly that the tapered metering pin extends through said orifice and has different relative positions with respect thereto as the rotor assembly moves relative to the metering element.

22. A carburetor as set forth in claim 18, wherein the spring means comprises a plurality of cantilever-type flat springs which extend between the housing and the rotor assembly, a flat closure surface on the metering element at the intersection of the lower end of the cylindrical portion of the rod and the upper end of the tapered metering pin and extending in a plane which is normal to the axis of the metering element, and a complementary flat surface at the upper end of the metering orifice adapted to engage the flat surface on said metering element to effect a positive closure of the orifice and shut-off of the fuel when the rotor assembly is in its uppermost position relative to the metering element.

23. A carburetor as set forth in claim 18, wherein the non-deformable guide means for positively guiding the rotor assembly in its vertical movement is a relatively elongate sleeve forming part of the rotor assembly with the bore of said sleeve slidable on the cylindrical surface of the metering rod, and a single annular seal surrounding the cylindrical portion of the rod in sealing engagement with the bore of the guide sleeve.

24. A carburetor for an internal combustion engine comprising, a housing having a fuel-air mixing chamber in its lower portion and a fuel inlet in its upper portion, a rotor assembly movable vertically within the housing and having a disk-like rotor member rotatably mounted on its lower end, said rotor member being disposed within the fuel-air mixing chamber, the fuel-air mixing chamber being formed by a generally annular wall and having an air inlet in its upper central portion, the chamber being defined by a first upper inwardly inclined wall surface which overlies the upper surface of the rotor member, a second wall surface of increasing diameter extending downwardly from the first wall surface and a third wall surface of decreasing diameter extending downwardly from the second surface to the outlet, resilient means between the rotor assembly and the housing urging the assembly and its rotor member upwardly within the chamber and into close proximity to said first and second wall surfaces to substantially close the air inlet to said chamber, means on the upper surface of the rotor responsive to the incoming air flow for rotating said rotor when the air inlet is opened by downward movement of the rotor member within the chamber.

said rotor member coacting with the first and second wall surfaces as said member moves downwardly to cause the incoming air to change direction and then flow across the upper surface of the member and again change direction as it passes downwardly around the periphery of the rotor member, such change creating sufficient inertial force to assure rotation of the rotor member instantaneously upon downward movement of the rotor, and a metering valve within the housing comprising a metering element mounted in a stationary position in the housing and a metering orifice carried by the rotor assembly, means for conducting fuel from the fuel inlet to said metering valve, and additional means for conducting the fuel which passes the metering valve to and through the rotor of said rotor assembly to distribute said fuel within the air in the fuel-air mixing chamber.

25. A carburetor for an internal combustion engine comprising, a housing having a fuel-air mixing chamber in its lower portion and a fuel inlet in its upper portion, a rotor assembly movable vertically within the housing and having a disk-like rotor member rotatably mounted on its lower end, said rotor member being disposed within the fuel-air mixing chamber and having its bottom surface exposed to the suction of the engine, the fuel-air mixing chamber being formed by a generally annular wall and having an upper inwardly inclined wall surface which overlies the upper surface of the rotor member, an air inlet in the upper wall which admits and directs air onto the upper surface of the rotor member at a point spaced inwardly of the periphery of said rotor member, resilient means between the rotor assembly and the housing urging the assembly and its rotor member upwardly within the chamber and into close proximity to the internal surface of the annular wall and to said overlying inclined wall surface to substantially close the air inlet to said chamber, means on the upper surface of the rotor responsive to the incoming air flow for rotating said rotor when the air inlet is opened by downward movement of the rotor member within the chamber, said rotor member coacting with the wall surfaces as said member moves downwardly to cause the incoming air to change direction and then flow across the upper surface of the member and again change direction as it passes downwardly around the periphery of the rotor member, such change creating sufficient inertial force to assure rotation of the rotor member instantaneously upon the application of the engine suction to the rotor, a metering valve within the housing comprising a metering element mounted in a stationary position in the housing and a metering orifice carried by the rotor assembly, means for conducting fuel from the fuel inlet to said metering valve, and additional means for conducting the fuel which passes the metering valve to and through the rotor of said rotor assembly to distribute said fuel within the air in the fuel-air mixing chamber.

26. A carburetor as set forth in claim 25, wherein the metering element is a rod which is cylindrical in cross-section throughout the major portion of its length and having a tapered metering pin extending downwardly from said cylindrical portion, and wherein said metering orifice is so located on the rotor assembly that the tapered metering pin extends through said orifice and has different relative positions with respect thereto as the rotor assembly moves relative to the metering element.

27. A carburetor for an internal engine comprising, a housing having a fuel-air mixing chamber in its lower portion and a fuel inlet in its upper portion, a rotor assembly movable vertically within the housing and having a disk-like rotor member rotatably mounted on its lower end, said rotor member being disposed within the fuel-air mixing chamber and having its bottom surface exposed to the suction of the engine, the fuel-air mixing chamber being formed by a generally annular wall and having an upper inwardly inclined wall surface which overlies the upper surface of the rotor member, an air inlet in the upper wall which admits and directs air onto the upper surface of the rotor member at a point spaced inwardly of the periphery of said rotor member, resilient means between the rotor assembly and the housing urging the assembly and its rotor member upwardly within the chamber and into close proximity to the internal surface of the annular wall and to said overlying inclined wall surface to substantially close the air inlet to said chamber, means on the upper surface of the rotor responsive to the incoming air flow for rotating said rotor when the air inlet is opened by downward movement of the rotor member within the chamber, said rotor member coacting with the wall surfaces as said member moves downwardly to cause the incoming air to change direction and then flow across the upper surface of the member and again change direction as it passes downwardly around the periphery of the rotor member, such change creating sufficient inertial force to assure rotation of the rotor member instantaneously upon the application of the engine suction to the rotor, a metering valve within the housing comprising a metering element mounted in a stationary position in the housing and a metering orifice carried by the rotor assembly, means for conducting fuel from the fuel inlet to said metering valve, additional means for conducting the fuel which passes the metering valve to and through the rotor of said rotor assembly to distribute said fuel within the air in the fuel-air mixing chamber, a flat annular closure surface on the metering element extending in a plane which is normal to the axis of the metering element, and a complementary flat surface at the upper end of the metering orifice adapted to engage the flat surface on said metering element to effect a positive closure of the orifice and shut-off of the fuel when the rotor assembly is in its uppermost position relative to the metering element.

* * * * *

UNITED STATES PATENT AND TRADEMARK OFFICE

CERTIFICATE OF CORRECTION

PATENT NO. :4,207,274
DATED :June 10, 1980
INVENTOR(S) :OLIVER V. PHILLIPS

It is certified that error appears in the above—identified patent and that said Letters Patent is hereby corrected as shown below:

In the heading on page 1, the line (73) should read as follows:

(73) Assignee: Karl M. Johnson, Jackson, Wyo.
part interest

Signed and Sealed this

*Twenty-fifth* Day of *October 1983*

[SEAL]

*Attest:*

GERALD J. MOSSINGHOFF

*Attesting Officer*

*Commissioner of Patents and Trademarks*